US010196804B2

(12) United States Patent
Roh et al.

(10) Patent No.: US 10,196,804 B2
(45) Date of Patent: Feb. 5, 2019

(54) SOLUTION SUPPLY

(71) Applicant: UNICO Co., Ltd., Bucheon-si (KR)

(72) Inventors: Yong Hwan Roh, Gongju-si (KR); Seung Hyun Roh, Guri-si (KR); Seo Hyun Roh, Guri-si (KR)

(73) Assignee: UNICO Co., Ltd. (KR)

( * ) Notice: Subject to any disclaimer, the term of this patent is extended or adjusted under 35 U.S.C. 154(b) by 0 days.

(21) Appl. No.: 15/604,619

(22) Filed: May 24, 2017

(65) Prior Publication Data

US 2018/0155911 A1 Jun. 7, 2018

(30) Foreign Application Priority Data

Dec. 6, 2016 (KR) ..... 10-2016-0165395

(51) Int. Cl.
*E03D 9/03* (2006.01)
*E03D 9/02* (2006.01)

(52) U.S. Cl.
CPC ..... *E03D 9/037* (2013.01); *E03D 2009/028* (2013.01)

(58) Field of Classification Search
CPC ..... E03D 9/037
USPC ..... 4/227, 3, 227.1–227.6; 422/265
See application file for complete search history.

(56) References Cited

FOREIGN PATENT DOCUMENTS

| | | |
|---|---|---|
| KR | 20-1999-0008141 | 2/1999 |
| KR | 20-2009-0004454 | 5/2009 |
| KR | 10-2012-0016468 | 2/2012 |
| KR | 10-2012-0016568 | 2/2012 |
| KR | 10-1170-1600000 | 7/2012 |
| KR | 10-2014-0147323 | 12/2014 |
| KR | 10-2016-0100690 | 8/2016 |

OTHER PUBLICATIONS

English translation of 10-2012-0016568.
English translation of 20-2009-0004454.
English translation of 20-1999-0008141.
English translation of 10-2014-0147323.
English translation of 10-1170-1600000.
English translation of 10-2012-0016468.
English translation of 10-2016-0100690.

*Primary Examiner* — Christine Skubinna

(57) ABSTRACT

A solution supply comprises a container having a space and a channel socket in the space to allow the solution to flow out of the container, the container floated by buoyance in a water tank and a feeder opening or closing the channel socket by buoyance and gravity in the water tank, wherein the feeder includes a dispenser having an upper portion and a lower portion, and wherein the upper portion of the dispenser includes a coupling body having an upper portion assembled with the channel socket along the same axis as the channel socket and moved by the buoyance of the container, and the lower portion of the dispenser includes a weight center base supporting the coupling body and a shutter stem coupled with an upper portion of the weight center base and having a stem seal for opening and closing to the channel socket.

8 Claims, 5 Drawing Sheets

SOLUTION SUPPLY

CROSS-REFERENCE TO RELATED APPLICATIONS

This patent application claims priority under 35 U.S.C. § 119 to Korean Patent Application No. 10-2016-0165395, filed on Dec. 6, 2016, in the Korean Intellectual Property Office, the disclosure of which is incorporated by reference herein in its entirety.

TECHNICAL FIELD

Embodiments of the present disclosure relate to solution supplies for supplying a solution by a height difference that occurs as water flows in or out of a water tank.

DISCUSSION OF RELATED ART

A flush toilet is configured to contain a predetermined amount of water in a water tank and to flush water down the toilet bowl to a septic tank. The water tank of the flush toilet maintains a predetermined water level by a valve that operates according to the water level.

Flush toilets, when not in use or unclean, may be subject to germ growth or contamination that is unhealthy or insanitary. Thus, several suggestions have been made to address such issues. An example is a type of toilet cleaner containing a solid cleaning tablet that soaks and melts in the toilet tank. Another example is a dispenser-type toilet cleaner that lets a cleaning solution flow down the toilet.

Such conventional toilet cleaners, however, consume too much of a cleaning agent, resulting in a waste of it. Therefore, a need exists for a high-reliability toilet cleaning mechanism that may prevent a waste, and any inconvenience in the supply of, a cleaning solution or refresher.

SUMMARY

According to an embodiment of the present disclosure, there is provided a solution supply that supplies a solution by a height difference that occurs as water flows in or out of the water tank. According to an embodiment of the present disclosure, a solution may be supplied to the water tank at a predetermined ratio.

According to an embodiment of the present disclosure, a solution supply comprises a container having a space in which a solution is contained and a channel socket provided in a direction of gravity in the space to allow the solution to flow out of the container, the container floated by buoyance in a water tank and a feeder opening or closing the channel socket by buoyance and gravity in the water tank, wherein the feeder includes a dispenser having an upper portion and a lower portion, and wherein the upper portion of the dispenser includes a coupling body having an upper portion assembled with the channel socket along the same axis as the channel socket and moved by the buoyance of the container, and the lower portion of the dispenser includes a weight center base supporting the coupling body and a shutter stem coupled with an upper portion of the weight center base and having a stem seal for opening and closing the channel socket.

According to an embodiment of the present disclosure, the water tank includes a toilet water tank, and wherein the solution includes one or more selected from the group consisting of a washing agent, a cleaning agent, a refreshing agent, a cleansing agent, a bleach, and a cleaning liquid.

According to an embodiment of the present disclosure, the channel socket has a thread through which the channel socket is fastened with the feeder.

According to an embodiment of the present disclosure, the feeder includes the coupling body having a coupling part that is connected with respect to the channel socket of the container, a flowpath part formed in the coupling body and allowing the solution to flow out through the channel socket, and the dispenser opening and closing the flowpath part.

According to an embodiment of the present disclosure, the coupling part includes a thread for a guided coupling of the channel socket.

According to an embodiment of the present disclosure, the stem seal includes a detachable O-shaped ring or a packing.

According to an embodiment of the present disclosure, the stem seal includes a slanted surface engaged with an inner wall of an upper flowpath part or a lower flowpath part of a flowpath part.

According to an embodiment of the present disclosure, the weight center base includes a weight balancer that adds a weight to the solution supply.

According to an embodiment of the present disclosure, the solution supply is disposed in a safe guide through an opening of the safe guide.

According to an embodiment of the present disclosure, the safe guide includes an opened upper part, a lower part having a plurality of rugs to be supported on a bottom of the water tank, and a support base disposed on the rugs to seat the weight center base of the solution supply thereon and a hole for an inflow or outflow of the solution or water.

According to the embodiments of the present disclosure, the solution supply is disposed in the water tank and is operated by a variation in water level that arises when water flows in or out of the water tank. In other words, the solution supply may be operated in a non-motorized manner, allowing for the supply of a predetermined or fixed amount of solution into the water tank without the need for complicated manipulation.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
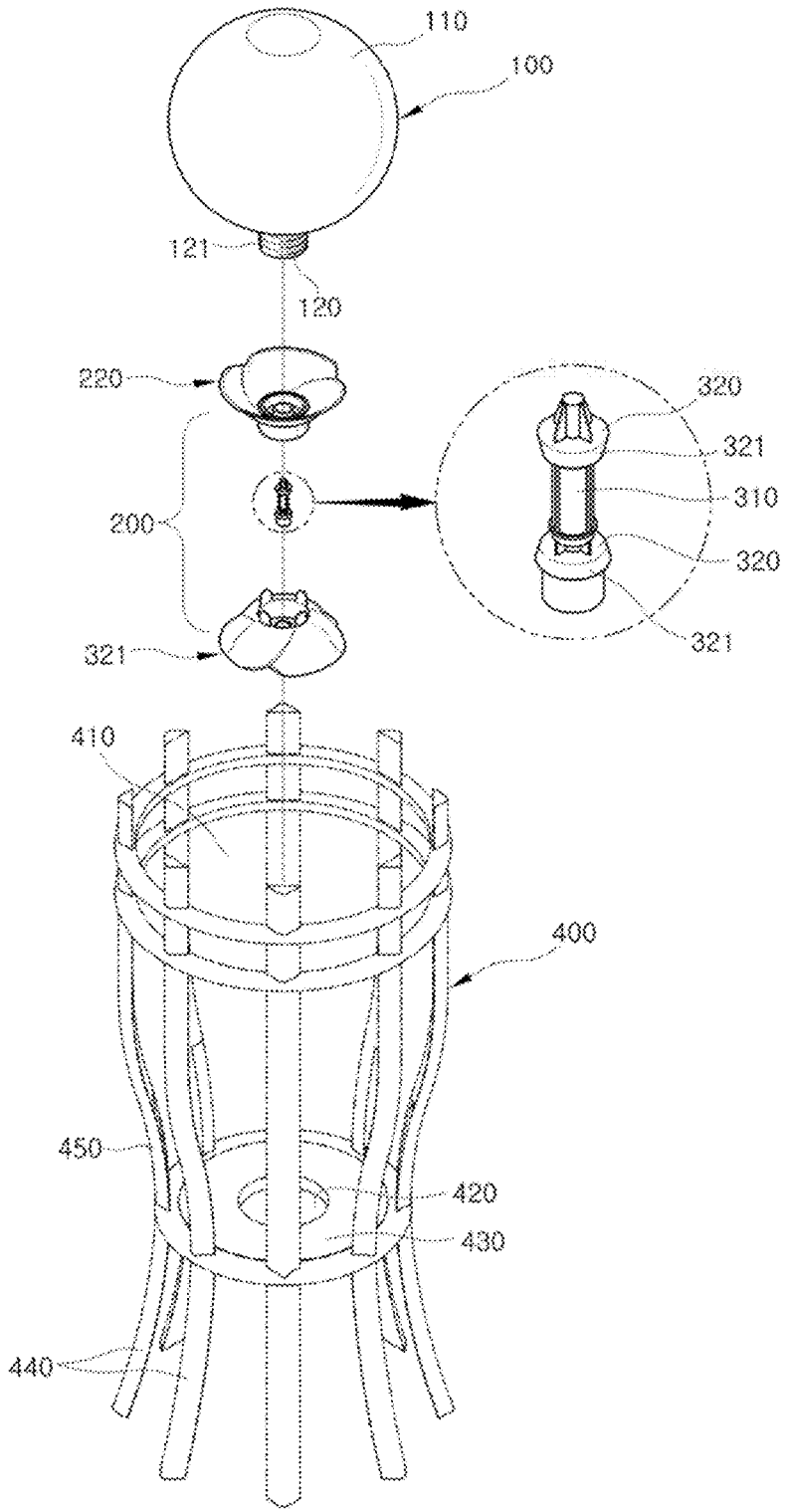
FIG. 1 is an exploded perspective view illustrating an example of a solution supply according to an embodiment of the present disclosure.

Hereinafter, exemplary embodiments of the present disclosure will be described in detail with reference to the accompanying drawings. Like reference denotations may be used to refer to like or similar elements throughout the specification and the drawings. The present disclosure, however, may be modified in various different ways, and should not be construed as limited to the embodiments set forth herein. As used herein, the singular forms "a," "an," and "the" are intended to include the plural forms as well, unless the context clearly indicates otherwise.

Although not shown in the drawings, a water tank Ta may include a normal water tank, such as that of a seating or squat toilet, where the water in the water tank is required to remain sanitary or clean by being supplied with a cleaning agent, refresher, washing agent, or other cleaning agents or solutions for sanitation or cleaning.

According to an embodiment of the present disclosure, a solution supply may be used in such various types of water tanks. The solution supply, when put in the water tank, may supply a predetermined or fixed amount of solution to the water tank by a dispenser and feeder that operate responsive to a variation in water level.

Figure 2:
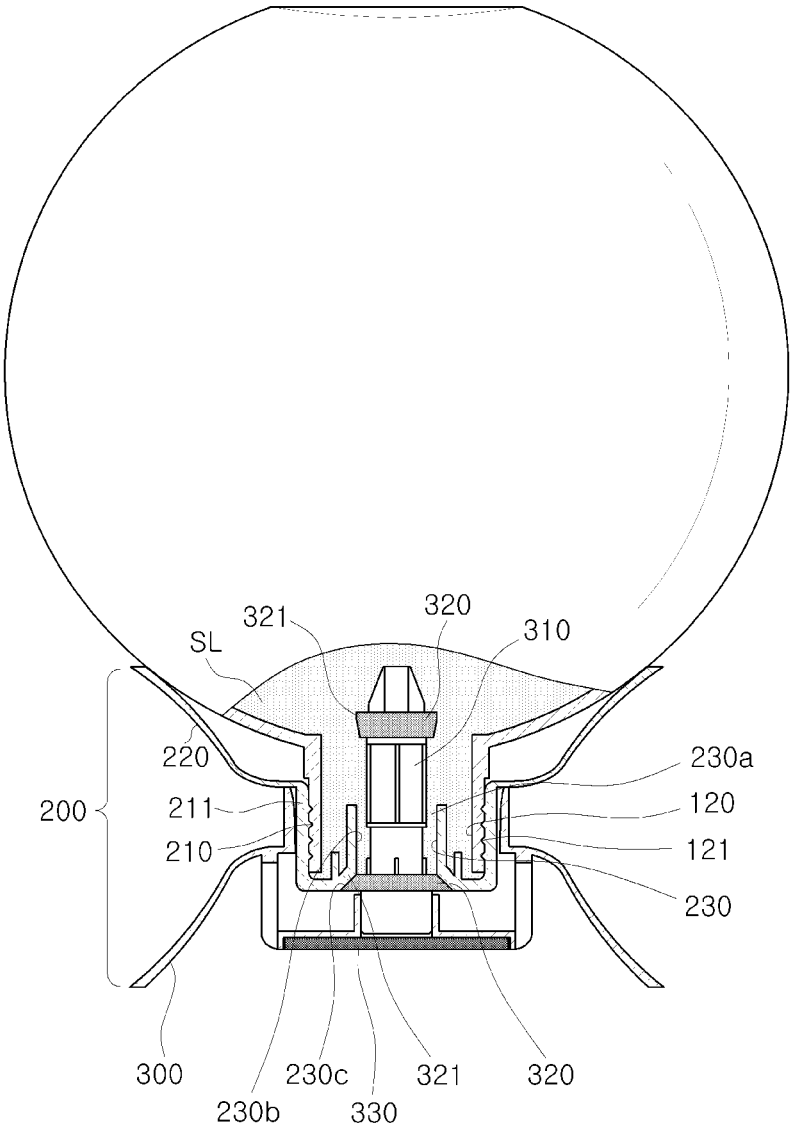
FIG. 2 is a cross-sectional view illustrating an example of a solution supply according to an embodiment of the present disclosure.

FIG. 1 is an exploded perspective view illustrating an example of a solution supply according to an embodiment of the present disclosure. FIG. 2 is a cross-sectional view illustrating an example of a solution supply according to an embodiment of the present disclosure.

Referring to FIGS. 1 and 2, a solution supply includes a container 100 and a feeder 200 having a dispenser according to an embodiment of the present disclosure.

The container 100 includes a space 110 in which a solution SL is contained and a channel socket 120 in a direction of gravity to discharge the solution from the space 110. The container 100 is configured to be floated in the water tank Ta by buoyance. The container 100 may be formed of, e.g., a lightweight, jar-shaped glass material or synthetic material that easily floats in the water.

The solution supply may include the feeder 200 that lets the solution flow out as the channel socket 120 of the container 100 is opened or closed by buoyance and gravity inside the container Ta.

The feeder 200 may include a dispenser that is assembled with the container 100 on the same axis as the channel socket 120 of the container 100 and moves in the direction of gravity.

Figure 3:
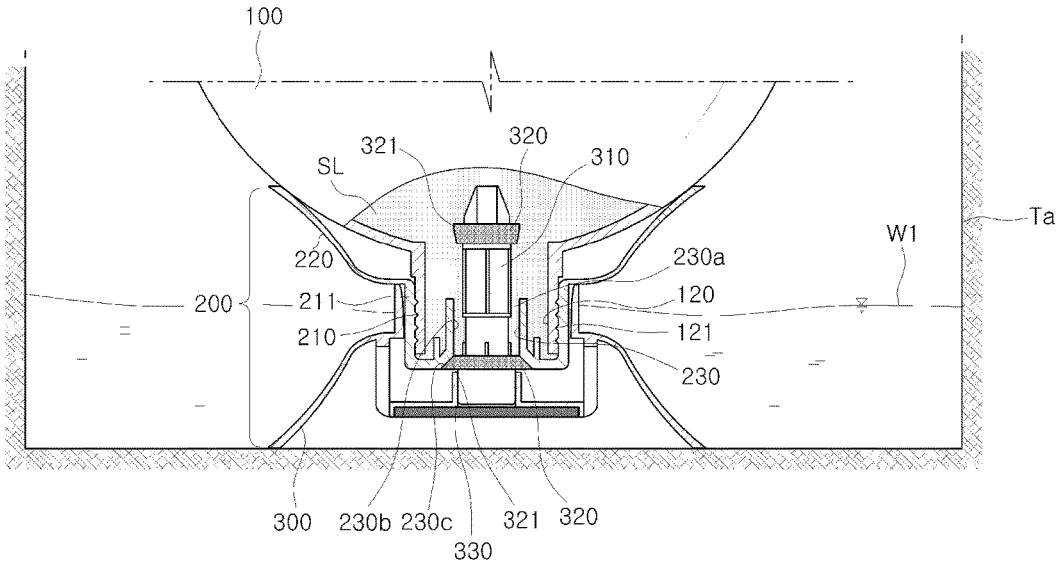
FIG. 3 is a view illustrating an example to which a solution supply is applied according to an embodiment of the present disclosure.

FIG. 3 is a view illustrating an example to which a solution supply is applied according to an embodiment of the present disclosure.

Referring to FIG. 3, a water tank Ta includes a toilet water tank. A solution contained in a container 100 may include one or more selected from the group consisting of a washing agent, a cleaning agent, a cleansing agent, a bleach, and other various types of cleaning tablets, agents, or solutions, but embodiments of the present disclosure are not limited to the type of the solution.

For example, a channel socket 120 for discharging the solution SL from the container 100 may have a thread 121 through which the channel socket 120 is coupled with the feeder 200. The structure of the assembly of the container 100 and the feeder 200 through the thread 121 leads to easier manipulation, maintenance and replacement of the parts of the solution supply and enables the container 100 and the feeder 200 to be separately produced and assembled in modules or parts.

For example, the feeder 200 may include a coupling body 220 having a coupling part 210 for fastening the feeder 200 with the container 100 through the channel socket 120, a flowpath part 230 formed in the coupling body 220 to discharge the solution that flows through the channel socket 120, and a dispenser for opening or closing the flowpath part 230.

For example, the coupling part 210 may include a thread 211 along which the channel socket 120 of the container 110 is fastened with the feeder 200.

As the coupling part 210 having the thread 211 is formed in the coupling body 220 as shown in FIG. 1, the thread 211 and the thread 121 of the channel socket 120 of the container 100 may be engaged and fastened together and sealed off, preventing a leak of the solution.

A flowpath part 230 of the feeder 200 may be configured in a single body that includes an upper flowpath part **230*b* and a lower flowpath part 230*c*. The upper flowpath part 230*b* of the flowpath part 230 may vertically extend, and the lower flowpath part 230*b* of the flowpath part 230 may extend slanted from a lower end of the upper flowpath part 230*b*. The lower flowpath part 230*b* may be larger in diameter than the upper flowpath pan 230*c*. A gap 230*a* is formed between the flowpath part 230 and the shutter stem 310**, allowing the solution to pass therethrough.

The diameter of the shutter stem 310 is configured to be smaller than a minimum diameter of the flowpath part 230 so that the gap **230*a*** may be formed to allow the solution to flow therethrough.

The dispenser functions as a valve that lets the solution SL in the container 100 flow into the water tank Ta or stops the solution SL from flowing into the water tank Ta. The dispenser includes a non-motorized shutter that opens or closes the channel socket 120 of the container 100 by a height difference that occurs as water flows in or out of the water tank Ta.

For example, the dispenser may include the shutter stem 310 that is provided along the flowpath part 230 in the channel socket 120 of the container 100 and stem seals 320 provided at two ends of the shutter stem 310.

A lower part of the shutter stem 310 is coupled to a weight center base 300 to be supported in a vertical direction. The weight center base 300 may be designed or configured to be partially or overall soaked under the water surface W and so that its center of weight is oriented in a vertical direction, thereby preventing the solution supply from significantly tilting or falling down, with the container 100 floated on the water surface. The solution supply, although temporarily tilting, may be quickly back to its vertical position by adjusting the center of weight of the solution supply.

For example, a weight balancer 330 may be attached to the weight center base 300 to add a weight, as necessary, so that the solution supply in the water tank is not tilted but remains at its balanced position.

The stem seals 320 provided at two portions of the shutter stem 310 may be replaced by O-shaped rings or packings (not shown) that are detachable. The stem seals 320, O-shaped rings, or packings (not shown) may seal off the upper flowpath part **230*b* or the lower flowpath part 230*c* when the shutter stem 310** linearly moves up or down, preventing a solution leak.

Outer side surfaces 321 of the stem seals 320 may be angled and shaped to be engaged with the inner side wall of the flowpath part 230, eliminating the need for a separate sealing material. For example, the outer side surfaces 321 of the stem seals 320 may have slanted surface that are engaged with the inner side wall of the flowpath part 320. The stem seals 320 may sealingly close the flowpath part 230, preventing the solution from flowing out of the container 100.

The operation of a solution supply is described below with reference to FIG. 4, according to an embodiment of the present disclosure.

Figure 4:
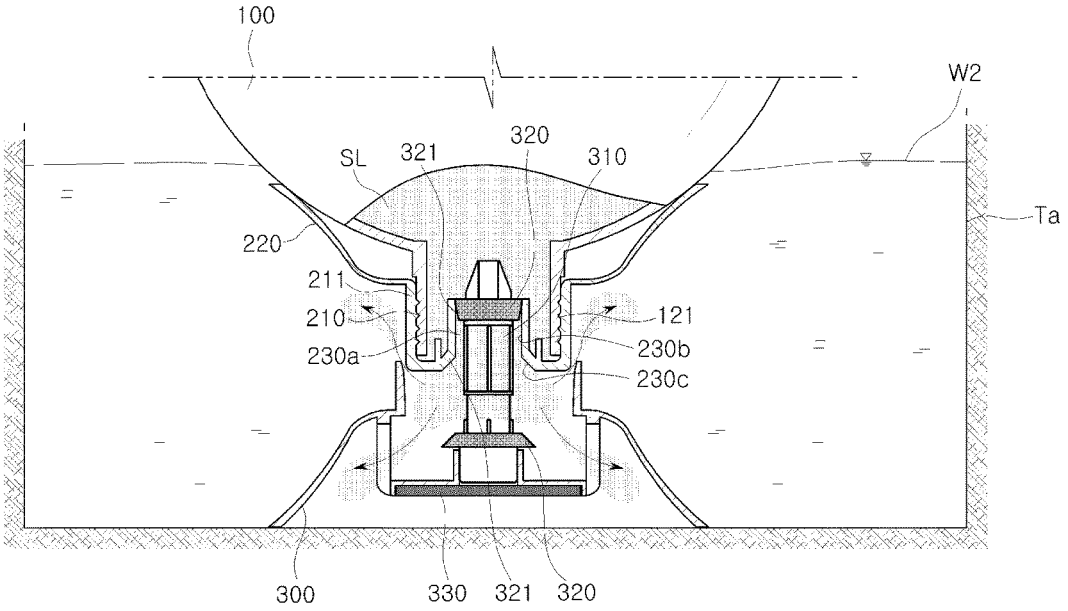
FIG. 4 is a view illustrating an example of the operation of a feeder and dispenser of a solution supply, according to an embodiment of the present disclosure.

FIG. 4 is a view illustrating an example of the operation of a feeder and dispenser of a solution supply, according to an embodiment of the present disclosure.

A solution supply, when put in the water tank Ta, may remain floated on the water surface W1 or W2 regardless of a variation in water level, e.g., from the water level of the water surface W1 to the water level of the water surface W2 of the water supplied into the water tank Ta. The solution supply may be rendered to remain at a balanced position on the water surface by buoyance despite a shake of the water tank or waves of the water. The balanced position may be determined considering the overall weight or volume of a solution to be supplied into the container 100 when determining the size and volume of the container 100.

Referring to FIG. 4, when a solution is contained in the container 100, and the solution supply is put in the water tank Ta, the coupling body 220 is rendered to ascend by the buoyance of the container 100, so that the upper stem seal 320 blocks the flowpath part 230, and the lower stem seal 320 is disengaged from the lower flowpath part 230*c*, thus discharging the solution SL through the flowpath part 230.

The upper stem seal 320 closes the flowpath part 230, cutting off the discharge of the solution SL from the container 100. When the water tank Ta flushes and the water level changes from water surface W2 to water surface W1, the buoyance applied to the container 100 is vanished, allowing the lower stem seal 320 to close the lower flowpath part 230*c* by the lower stem seal 320 and the upper stem seal 320 to open the flowpath part 230 so that the upper flowpath part 230 is filled with the solution SL.

In the initial state of the solution supply put in the water tank Ta, the solution is prevented from flowing into the lower flowpath part 230*c* by the stem seal 320 of the dispenser, as illustrated in FIG. 3. Thus, the wait state in which the supply of the solution into the water tank is cut off may continue regardless of the weight of the container.

FIG. 4 illustrates an example in which the supply of the solution is underway. The supply of the solution may occur when there is a variation in water level. In other words, when the water level varies from the water level of an initial water surface (e.g., water surface W1 of FIG. 3) to the water level of another water surface (e.g., water surface W2 of FIG. 4), the weight center base 300 coupled with the shutter stem 310 is stationary, but the container 100 pulls up the coupling body 220 by an action of buoyance that arises as the water level ascends, leading to the lower stem seal 320 opening the lower flowpath part 230*c*. Thus, the solution flows from the flowpath part 230 to the water.

The solution SL may be discharged through the gap that is temporarily formed between a lower end surface of the coupling body 220 of the container 100 and an upper end surface of the weight center base 300 when the water level of the water tank rises.

When the water level of the water tank is lowered, the lower stem seal 320 and the lower flowpath part 230*c* are brought in tight contact with each other by the weight of the container 100, stopping a further leak of the solution SL.

As such, the stem seals 320 selectively open and close the upper flowpath part 230*b* and the lower flowpath part 230*c* as buoyance acts to the container 100, allowing the solution SL to flow out from the flowpath part 230 through the gap. The total amount of the solution that flows out may be substantially the same as the amount of the solution that fills the flowpath part 230 in the wait state as shown in FIG. 4, and thus, this amount may be close to a fixed or predetermined amount. In other words, the solution SL may be supplied into the water in a predetermined ratio whenever a variation in water level occurs.

Figure 5:
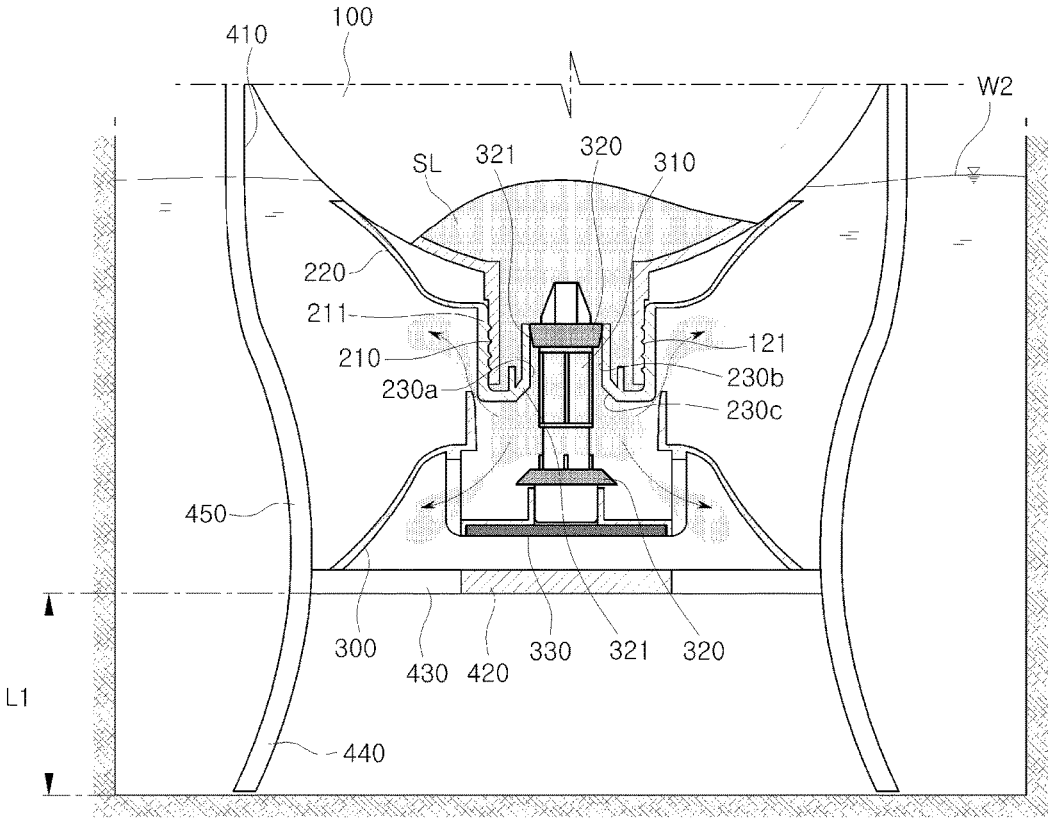
FIG. 5 is a view illustrating an example of use of a shape guide for a solution supply according to an embodiment of the present disclosure.

FIG. 5 is a view illustrating an example of using a safe guide of a solution supply according to an embodiment of the present disclosure.

Referring to FIG. 5, a safe guide 400 has an opening 410 at an upper part thereof, receiving the solution supply therethrough. The use of the safe guide 400 prevents the solution supply from being fallen down or tilted when the water waves or wobbles, allowing for the supply of the solution in a steady and stable manner.

For example, the safe guide 400 has the opening 410 at its upper part, allowing for easier insertion of the solution supply. The safe guide 400 also includes multiple rugs 440 at its lower part to secure a predetermined gap L1 from the bottom of the water tank. A support base 430 is placed on the rugs 440, so that the weight center base 330 of the water supply is seated on the support base 430. For example, the support base 430 may include a hole through which the solution SL and water can freely flow in or out.

By using the solution supply with the solution supply placed in the safe guide, the weight center base 300 of the solution supply may be supported while being spaced apart from the bottom of the water tank Ta, so that the solution SL can be supplied when the water level from the bottom of the water tank reaches a predetermined value or more, and the solution supply may stably supply the solution SL without falling down despite water shakes or wobbles.

The safe guide 400 may be shaped to have gaps that allow the water to freely flow in or out through the overall safe guide 400. For example, a middle part of the safe guide 400 may be inwardly arched from an upper or lower part of the safe guide 400 so that the safe guide 400 is securely supported in the water tank Ta.

A solution supply according to the present disclosure enables the supply of a predetermined or fixed amount of solution each time the toilet is used, allowing the toilet to remain clean while preventing a waste of the solution and eliminating the need for unnecessary care of the toilet. The container can easily be refilled when the solution runs short, leading to convenience. The solution supply may also be applied for other various purposes, rather than intended only for use in toilets, achieving the same or similar advantages.

While the present disclosure has been shown and described with reference to exemplary embodiments thereof, it will be apparent to those of ordinary skill in the art that various changes in form and detail may be made thereto without departing from the spirit and scope of the present disclosure as defined by the following claims.

What is claimed is:

1. A solution supply, comprising:

a container having a space in which a solution is contained and a channel socket provided in a direction of gravity in the space to allow the solution to flow out of the container by gravity, wherein the container is floatable by buoyance in a water tank; and a feeder for opening or closing the channel socket by buoyance and gravity in the water tank, wherein the feeder includes a dispenser having an upper portion and a lower portion, and wherein the upper portion of the dispenser includes a coupling body having an upper portion assembled with the channel socket along the same axis as the channel socket and moved by the buoyance of the container, and the lower portion of the dispenser includes a weight center base supporting the coupling body and a shutter stem coupled with an upper portion of the weight center base and having a stem seal for opening and closing the channel socket, wherein the solution supply is disposed in a safe guide through an opening of the safe guide, wherein the safe guide includes a lower part having a plurality of rugs to be supported on a bottom surface of the water tank, wherein a support base is disposed at a location spaced apart from the bottom space of the water tank so that the weight center base of the solution supply is to be seated thereon, wherein a hole is formed in the support base for an inflow or outflow of the solution or water.

2. The solution supply of claim 1, wherein the water tank includes a toilet water tank, and wherein the solution includes one or more selected from the group consisting of a washing agent, a cleaning agent, a refreshing agent, a cleansing agent, a bleach, and a cleaning liquid.

3. The solution supply of claim 1, wherein the channel socket has a thread through which the channel socket is fastened with the feeder.

4. The solution supply of claim 1, wherein the feeder includes the coupling body having a coupling part that is connected with respect to the channel socket of the container, a flowpath part formed in the coupling body and allowing the solution to flow out through the channel socket, and the dispenser opening and closing the flowpath part.

5. The solution supply of claim 4, wherein the coupling part includes a thread for a guided coupling of the channel socket.

6. The solution supply of claim 1, wherein the stem seal includes a detachable O-shaped ring or a packing.

7. The solution supply of claim 1, wherein the stem seal includes a slanted surface engaged with an inner wall of an upper flowpath part or a lower flowpath part of a flowpath part.

8. The solution supply of claim 1, wherein the weight center base includes a weight balancer that adds a weight to the solution supply.

* * * * *